United States Patent [19]

Beaudoin

[11] 3,961,783

[45] June 8, 1976

[54] ENDLESS BELT FOLDER

[75] Inventor: John F. Beaudoin, Milwaukee, Wis.

[73] Assignee: Pratt Manufacturing Corporation, Milwaukee, Wis.

[22] Filed: Mar. 12, 1975

[21] Appl. No.: 557,549

[52] U.S. Cl. ..... 270/66; 270/86

[51] Int. Cl.[2] ..... B65H 45/22

[58] Field of Search ..... 270/86–94, 270/66; 83/6–8, 10, 11, 326; 93/58.2 R, 58.2 F

[56] References Cited

UNITED STATES PATENTS 331,281 12/1885 Crowell ..... 270/86

3,202,066 8/1965 Palmer ..... 270/94

*Primary Examiner*—Edgar S. Burr
*Assistant Examiner*—A. Heinz
*Attorney, Agent, or Firm*—Arthur L. Morsell, Jr.

[57] ABSTRACT

Folding apparatus includes an endless grooved belt mounted for movement along a linear folding path opposite a second endless belt which is V-shaped in cross-section for coaction with the groove of the grooved belt to thereby create a fold in sheet material therebetween.

9 Claims, 6 Drawing Figures

Fig. 4
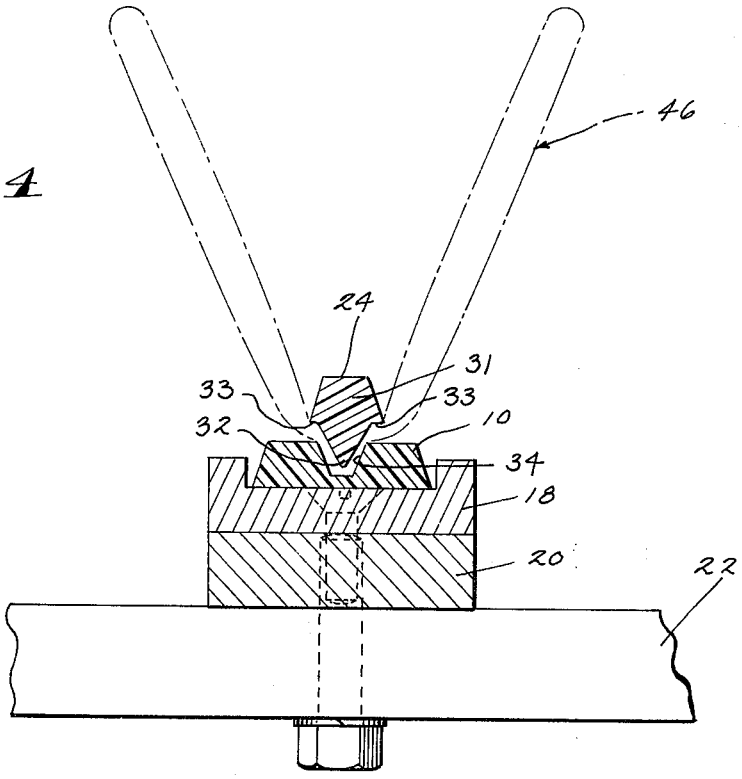
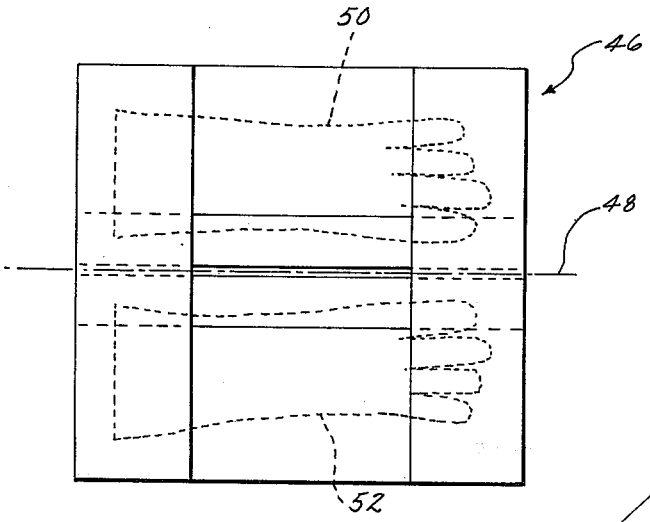
Fig. 5
Fig. 6
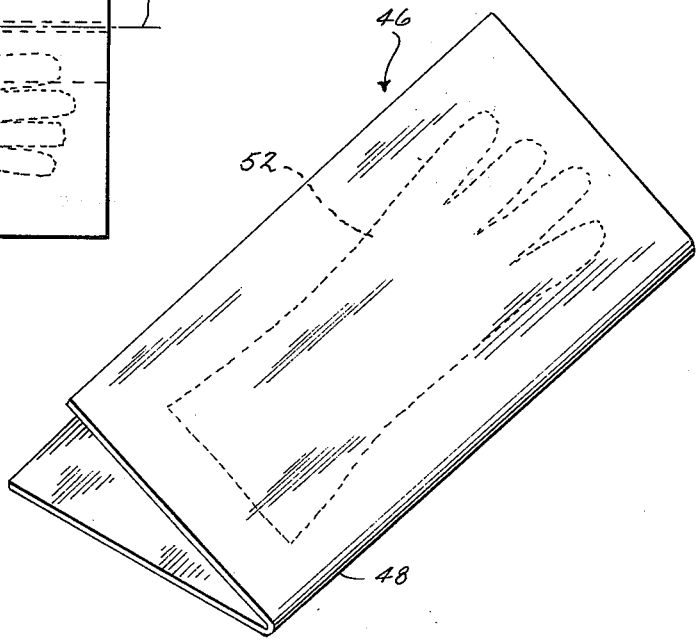

ENDLESS BELT FOLDER

BACKGROUND OF THE INVENTION

This invention relates to folding apparatus for sheet material such as paper or plastic film. The apparatus is particularly useful in packaging machinery. In some prior art folders, sheet material is folded while it is stationary, and in others moving sheet material is folded as it moves into engagement with stationary forms that are shaped to progressively lift opposite sides of the sheet material and thereby form a fold. This invention is an improvement over both of these types of prior art folders.

SUMMARY OF THE INVENTION

Flat sheet material to be folded is passed between an endless grooved belt and a second endless belt which is shaped in cross-section and positioned to fit in the groove of the grooved belt to thereby cause folding of the sheet material. Both belts move at the same speed and preferably coact along a linear folding path. The flat sheet material is fed between the folding belts at one end of the folding path, and the folded material is removed from the belts at the other end of the folding path.

DESCRIPTION OF THE DRAWINGS

FIG. 4 is a fragmentary sectional view taken on the line 4—4 of FIG. 2.

FIG. 5 is a plan view of a flat surgical glove package to be folded along a line intermediate its width.

FIG. 6 is a perspective view of the package of FIG. 5 folded along a central longitudinal fold line.

DESCRIPTION OF THE PREFERRED EMBODIMENT

Figure 1:
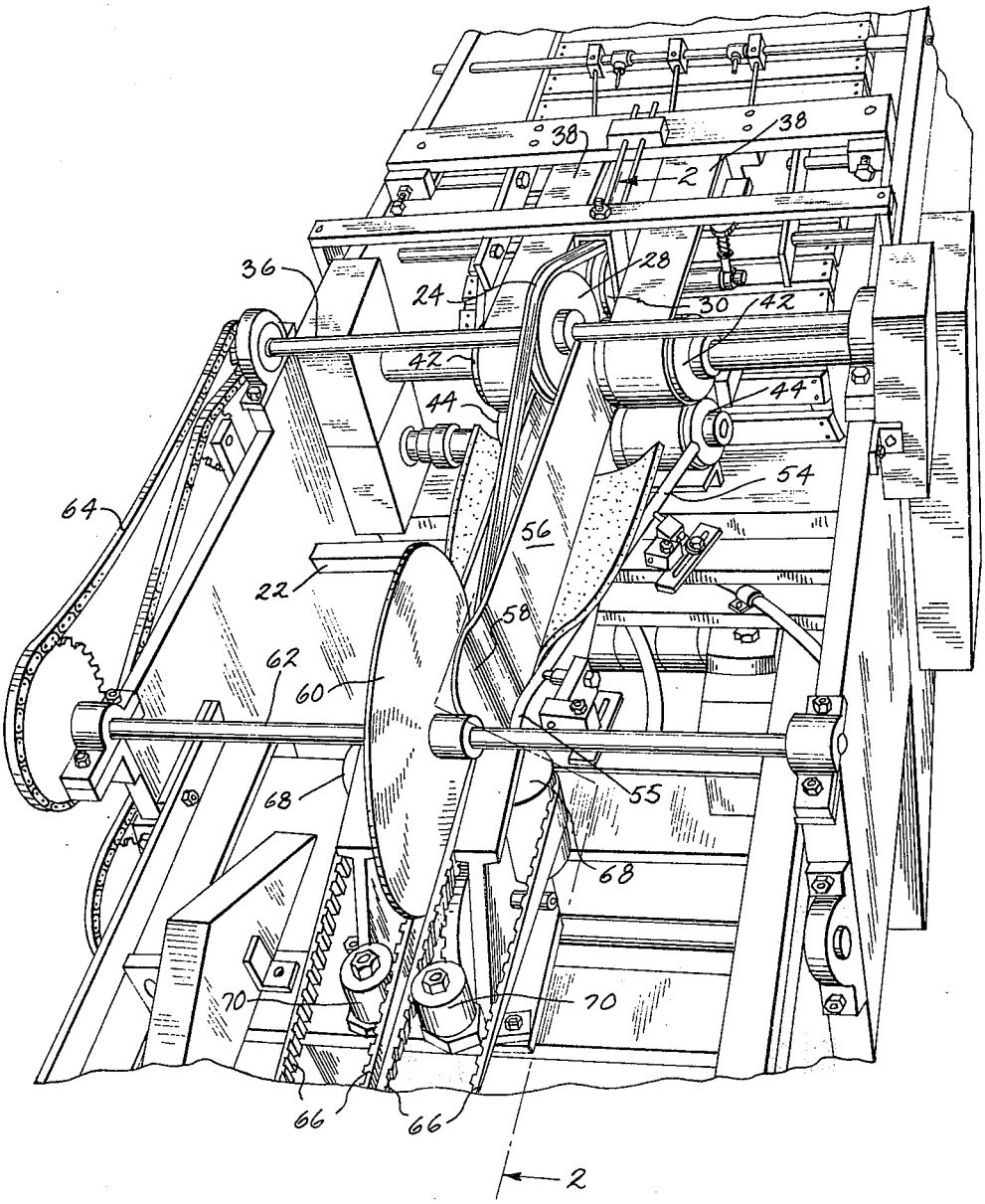
FIG. 1 is a perspective view of one embodiment of the invention looking principally at the top, parts of the apparatus being broken away.
Figure 2:
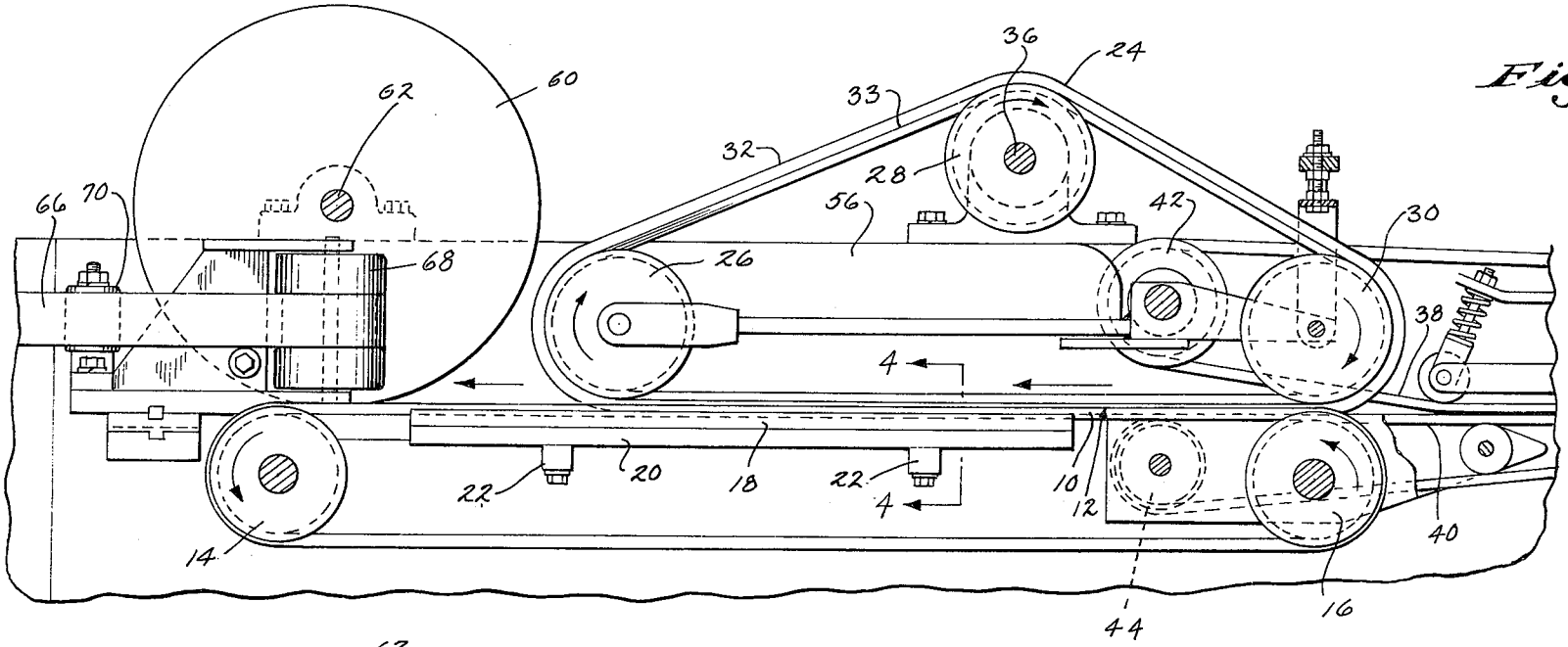
FIG. 2 is a longitudinal sectional view taken along the line 2—2 of FIG. 1.

Referring to FIGS. 2 and 4, an endless grooved belt 10 is mounted for movement along a linear folding path 12 on pulleys 14 and 16 which are mounted by conventional means on a machine frame. Pulley 14 is rotated counter-clockwise in FIG. 1 by conventional means (not shown) to move grooved belt 10 from right to left along folding path 12 in FIG. 2, as indicated by the arrow. Folding path 12 extends from the top of pulley 16 to the top of pulley 14. Grooved belt 10 is supported along a portion of folding path 12 by a grooved guide track 18 (FIG. 4) which is supported by an elongated base strip 20 on cross members 22.

A second endless belt 24 has an inner cross-sectional portion 31 in the form of an isosceles trapezoid for coaction with conventional pulley grooves. The outer portion of the cross-section (the lower portion in FIG. 4) has a ridge 32 which is V-shaped, and there are shoulders 33 between the V-shaped portion and the inner portion 31. The belt 24 is mounted for movement along folding path 12 opposite grooved belt 10 by pulleys 26, 28 and 30. Pulleys 26 and 30 are idler pulleys and are supported by conventional means in such position as to cause the apex portion of ridge 32 of the cross-section of the belt 23 (FIG. 4) to travel in the groove 34 of grooved belt 10, apex 32 being positioned close enough to the walls of the groove 34 to cause flat sheet material passing therebetween to be gripped and folded as described hereinafter and as shown by broken lines in FIG. 4. Pulley 28 is rigidly mounted on a shaft 36 (FIG. 1) which is rotated clockwise in FIG. 2 by conventional means (not shown) to move V-shaped belt 24 from the right to the left in FIG. 2 along folding path 12, as indicated by the arrow. The rotary drive for shaft 36 is synchronized with the drive for pulley 14 by conventional means (not shown) so that grooved belt 10 and V-shaped belt 24 travel at the same linear speed along folding path 12.

Flat sheet material which is to be folded is fed between belts 10 and 24 at one end of folding path 12 by conveyor belts 38 and 40 (FIGS. 1 and 2) which pass around rollers 42 and 44 (FIG. 1) and around other suitable rollers not shown in the drawings. Conveyor belts 38 and 40 are driven by conventional means (not shown) at the same linear speed as folding belts 10 and 24 so as to smoothly deliver the sheet material therebetween at the upstream end of folding path 12. In this particular example, the flat sheet material to be folded comprises flat packages 46 (FIG. 5) for surgical gloves or the like which are to be folded along a longitudinal center line 48 to produce the folded package shown in FIG. 6. It should be understood, however, that surgical glove packages are only one example of the material that can be folded by this apparatus, as other types of packages can be folded.

Each package 46 contains one pair of surgical gloves, one in a folded pocket on each side of the longitudinal center line 48 along which the package is to be folded by the present machine. The position of the gloves in the pockets is indicated in FIG. 5 by the broken outlines 50 and 52. When the central portion of package 46, along center line 48, is pressed between grooved belt 10 and the V-shaped portion of belt 24, as shown in FIG. 4, package 46 is transported and folded along center line 48 at a fold angle depending on the apex angle of V-shaped portion 32 and groove 34.

Figure 3:
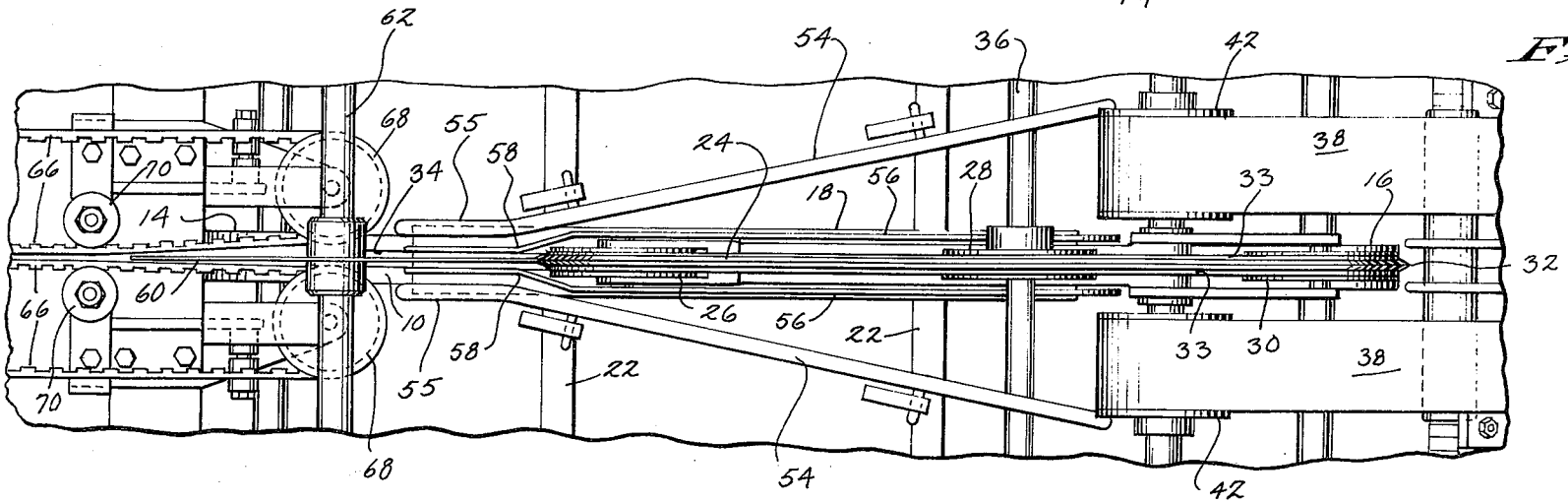
FIG. 3 is a fragmentary plan view showing parts of the folder of FIG. 1.

In some embodiments of the invention, the folding action of belts 10 and 24 may be sufficient to produce the desired fold. However, in this embodiment, the weight of gloves 50 and 52 requires some support in lifting the opposite sides of package 46 to form the folded package shown in FIG. 6. The required support is provided by converging folding rails 54 (FIGS. 1 and 3) which are mounted alongside folding path 12 in such a position as to support opposite sides of packages 46 as they move along folding path 12. Rails 54 not only converge inwardly but also angle upwardly to progressively lift and further fold the sides of package 46 as they travel along folding path 12, until the package sides are substantially parallel to each other at the end of folding path 12. The inward slope of rails 54 is most clearly seen in FIG. 3 and the upward slope is most clearly seen in FIG. 1.

The folded halves of package 46 are protected from contact with pulley 26 and associated parts by a pair of upstanding plates 56 (FIGS. 1 and 3) which act as shields.

Immediately downstream from pulley 26, shield plates 56 are offset toward each other at 58 to permit the opposite halves of folded package 46 to stand upright supported by the downstream end of rails 54 which have become parallel as at 55.

To impress a sharp crease in package 46 along fold line 48, a thin metal creasing disc 60 is rotatably mounted by conventional means in such a position as to press package 46 into the groove 34 of grooved belt 10 immediately upstream from pulley 14. Creasing disc 60 is rigidly attached to shaft 62 (FIG. 1) which is connected by a conventional chain drive 64 to driven shaft 36. Chain drive 64 is arranged to cause rotation of the creasing disc 60 at such speed and direction as to properly match the speed and direction of folding belts 10 and 24. The diameter of creasing disc 60 is large enough that the folding packages 46 will pass under shaft 62.

At both sides of creasing disc 60, the opposite sides of folded package 46 are engaged by opposed and converging stretches of resilient conveyor belts 66 which extend around rollers 68, and which are driven by conventional means (not shown), at the same linear speed as folding belts 10 and 24. Idler rollers 70 bear against conveyor belts 68 downstream of creasing disc 60 to prevent inward flexing of the belts 66. Conveyor belts 66 carry the folded packages 46 to the next step in the processing cycle.

While in the preferred form of the invention the belts move along a common folding path where there are relatively long stretches where the ridge of the one belt is engaged in the groove of the other belt, it is obvious that for certain products a short coaction of the belts may be all that is necessary to accomplish folding. Various other changes and modifications may be made without departing from the spirit of the invention, and all of such changes are contemplated as may come within the scope of the claims.

What I claim is:

1. Folding apparatus for sheet material comprising a first endless belt having an exposed sheet-engaging face with a permanent groove therein, a narrow second endless belt having an exposed sheet-engaging face with a permanent longitudinal ridge, and means for mounting said belts for conjoint movement with portions of said exposed faces in longitudinal linear engagement along a linear folding path, with the ridge of the second belt in interfitting engagement with the groove of the first belt to receive flat sheet material therebetween for folding of opposite sides of the sheet material toward each other, the groove of the first belt being a substantial depth and the ridge of the second belt projecting a substantial distance into said groove, and said ridge and groove being sized and shaped relative to one another to cause partial folding of said opposite sides of the sheet toward each other on opposite sides of said narrow second belt and means for completing said folding.

2. The folding apparatus of claim 1 wherein said means for completing said folding includes converging stationary folding rails embracing said folding path and positioned to engage and support said opposite sides of said sheet material as said sheet material is moved along said folding path by said endless belts.

3. The folding apparatus claimed in claim 2 wherein said converging folding rails are also disposed in a plane at an oblique angle with respect to the folding path in a direction to support and further fold said opposite sides of said sheet material.

4. The folding apparatus claimed in claim 1 wherein the groove in said grooved first belt is U-shaped in cross section with diverging sides, and wherein the ridge of said second belt is inverted V-shaped in cross section.

5. The folding apparatus claimed in claim 1 wherein there is an elongated guiding track extending along said folding path and supporting that portion of said grooved first belt which is in said linear folding path.

6. The folding apparatus claimed in claim 5 wherein said guiding track has a longitudinal groove within which the grooved first belt fits for sliding movement.

7. The folding apparatus claimed in claim 1 wherein that portion of the grooved first belt which is in said folding path has an extending portion extending beyond that portion of the second belt which is in the folding path, and wherein there is a creasing disc rotatably mounted adjacent said extending portion in a position to press said sheet material into the groove of said grooved belt to more sharply crease said sheet material, and wherein there is means for rotating said creasing disc at a peripheral speed which is equal to the linear speed of said grooved belt.

8. The folding apparatus of claim 7 wherein there is a pair of other belts having converging portions positioned to receive said opposite side portions of said sheet material therebetween after it has been acted on by said first and second belts and by said creasing disc.

9. The folding apparatus claimed in claim 1 wherein there is a pair of other belts having converging portions positioned to receive said folded sheet material therebetween after it has been acted on by said first and second belts to maintain the side portions of the sheets in folded condition.

* * * * *